United States Patent [19]

Bing et al.

[11] 4,044,430

[45] Aug. 30, 1977

[54] CLASP FOR JEWELRY CHAIN

[76] Inventors: Bari Bing, 128 W. Caranetta Terrace; Barbara S. Sloan, 1425 Cedarview Ave., both of Lakewood, N.J. 08701

[21] Appl. No.: 619,836

[22] Filed: Oct. 6, 1975

[51] Int. Cl.[2] ..... A44B 19/00

[52] U.S. Cl. ..... 24/201 R; 24/238; 24/240

[58] Field of Search ..... 24/201 R, 201 BN, 201 S, 24/201 HE, 215, 218, 228, 238, 240

[56] References Cited

U.S. PATENT DOCUMENTS

| | | | |
|---|---|---|---|
| 992,301 | 5/1911 | Walsh | 24/238 X |
| 1,004,171 | 9/1911 | James | 24/240 |
| 1,201,175 | 10/1916 | Grunwald | 24/238 |
| 2,222,053 | 11/1940 | Waller | 24/240 |
| 2,239,304 | 4/1941 | Stell | 24/238 |
| 3,570,078 | 3/1971 | Neumann et al. | 24/201 BN |

*Primary Examiner*—Paul R. Gilliam
*Assistant Examiner*—Victor N. Sakran
*Attorney, Agent, or Firm*—Peter L. Berger

[57] ABSTRACT

A clasp for jewelry chains which comprises a hook and separate keeper member, the hook and keeper members being attached to respective opposite ends of the chain. The keeper member has a curved channel segment conforming in shape to a curved segment of the hook member such that the hook member is slid within the channel section and held in place by dynamic tension, while a shank section of the hook member is snap-fitted between two spaced-apart shoulders formed in a mouth portion of the keeper member to securely hold the hook and keeper member together.

2 Claims, 5 Drawing Figures

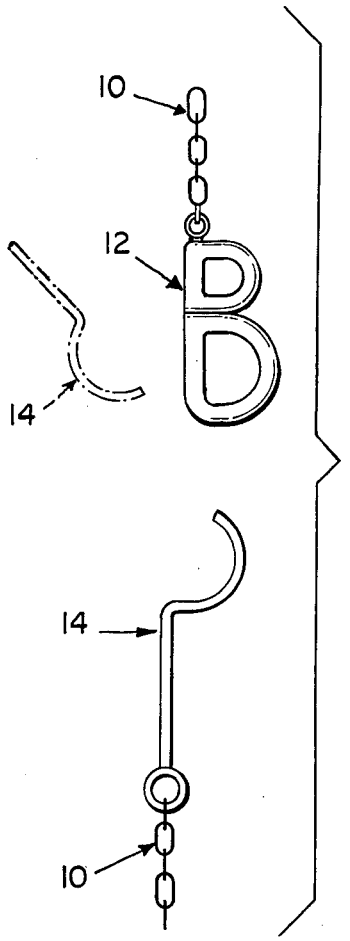
FIG. 1
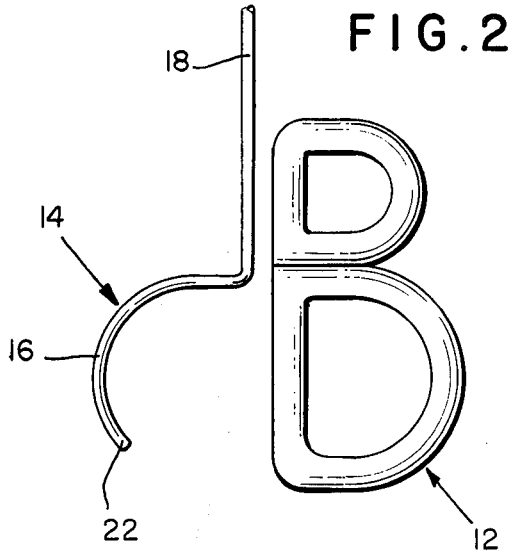
FIG. 2
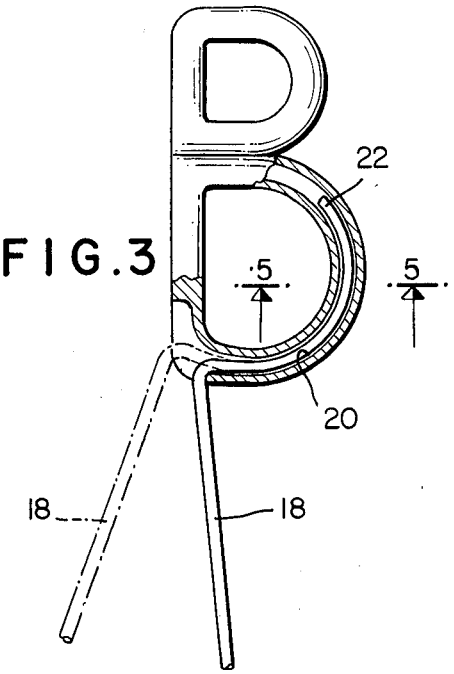
FIG. 3
FIG. 4
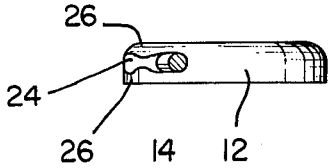
FIG. 5
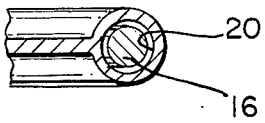

CLASP FOR JEWELRY CHAIN

BACKGROUND OF THE INVENTION

This invention relates to a clasp for jewelry chains, and more particularly, for a clasp which is simple and effective in operation.

Clasps for jewelry are often unattractive and difficult to use. Frictional fitting members often separate after long periods of use while ring and hook type assemblies are both unattractive and often ineffective in operation after a period of time.

An object of this invention is to provide an improved clasp for jewelry chains and the like.

Another object of this invention is to provide such a jewelry clasp which is simple and efficient in operation.

Yet another object of this invention is to provide such a clasp which may be artistically attractive and enhance the chain and jewelry to which it is attached.

Still another object of this invention is to provide such a jewelry clasp which can be efficiently manufactured.

Another object of this invention is to provide a jewelry clasp which is securely held together.

Other objects, advantages and features of this invention will become more apparent from the following description.

SUMMARY OF THE INVENTION

In accordance with the principles of this invention, the above objects are accomplished by providing a clasp for jewelry chains which comprises separate hook and keeper members, the hook member comprising a shank segment and a hook segment, with the hook segment being curved and having a distal end. The keeper member is also curved with the curvature of both the keeper and hook members being the same, so as to permit the hook member to fit within the keeper member. The keeper member is provided with a channel portion terminating in a mouth section, the mouth section being formed of oppositely extending shoulder portions. The distal end of the hook segment is placed in the mouth portion and the hook is then pivoted about the center of the curvature of the channel portion of the keeper with the curved hook segment moving in the channel section of the keeper member. The shank portion of the hook member has a width slightly greater than the spacing between the shoulder members, and the hook member is firmly snapped into place between the shoulder members. When fully inserted in place, the hook and keeper are securely held together and the chain attached thereby is securely closed. Repeated and long usage will not detract from the security of the connection because of the dynamic tension which holds the hook and keeper members together due to the similarly shaped arcuate or curved portions thereof.

BRIEF DESCRIPTION OF THE DRAWINGS

FIG. 1 is a plan view of the hook and keeper members of this invention being attached to a jewelry chain;

FIG. 2 is a partial sectional view showing the hook and keeper members separately;

FIG. 3 is a partial sectional view showing the hook member fully inserted within the keeper member;

FIG. 4 is an end view showing the shank portion of the hook member fitting between the extending shoulder portions forming the mouth segment of the keeper member;

FIG. 5 is a sectional view along lines 5—5 of FIG. 3.

DETAILED DESCRIPTION

Referring to the drawings, there is shown in FIG. 1 a jewelry chain 10 having opposite ends connected to a keeper member 12 and a hook member 14. The hook member 14 is adapted to be seated and fit within the keeper member 12 in accordance with the principles of this invention. It should be noted that the keeper member 12 is capable of assuming an artistic shape which enhances its marketability and its desirability in both function and use.

Referring to FIG. 2, there is shown the keeper and hook member in greater detail, with the keeper member being formed as the letter B, and the hook member having a curved or arcuately shaped hook segment 16 attached to a shank segment 18 forming the hook. The shape of hook segment 16 conforms to the arcuate shape of a channel portion 20 formed within the bottom portion of the letter B, the complementary curved sections enabling the hook segment 16 to fully fit within the curved bottom portion of the B 20 enabling a secure and tight fit.

Referring to FIG. 3, there is shown in more detail the hook segment 16 fitting within the curved channel 20 of keeper member 12. It should be noted that the distal end 22 of the hook member is first fitted into a mouth portion 24 of the keeper member (FIG. 2) and the hook member is then pivoted around the center of the arcuate shape of the channel 20 enabling it to be fully inserted within the channel 20.

Referring to FIG. 4, there is shown a pair of oppositely extending shoulders 26 forming the mouth portion and the shank 18 of the hook member, it being noted that the distance between the shoulder portions 26—26 is less than the thickness of the shank member 18, so that when the hook is fully inserted within the keeper member 12, the shank 18 is snap fitted into place further securing the fit between the hook and keeper members.

Referring to FIG. 5, there is shown a sectional view through lines 5—5 of FIG. 3 illustrating that the cross sectional shape of the channel section 20 formed in the lower portion of the letter B illustrated in FIG. 2.

When the hook portion is fully inserted within the keeper member as illustrated in FIG. 3, the chain is securely fastened because of the dynamic tension formed between the hook segment 16 resting within the channel segment 20, and further securely supported by the snap action of the opposing shoulder members 26 cooperating with the shank 18.

It can be appreciated that the shape of the keeper 12 can be any desired configuration so long as the hook and keeper segments are provided with arcuately shaped conforming surfaces enabling the hook member to be fully inserted within the keeper member and channel portion thereof to secure the jewelry clasp together.

The above invention has been described with particular emphasis on the embodiments disclosed above, but other variations can and are to be considered as part of the principles of this invention within the constraints and limitations of the enclosed claims.

We claim:

1. A clasp for jewelry chains comprising a hook member and a keeper member, said hook member having a shank segment and a hook segment, said hook segment being arcuate in shape and having a distal end, said keeper member comprising an arcuately shaped enclosed channel section, the arcuate shape of said channel section conforming to the arcuate shape of said hook segment, one end of said arcuately shaped channel section being closed and the other end terminating in an open mouth portion, said mouth portion being adapted to receive the distal end of said hook segment, said channel section and said hook segment cooperating to permit said hook member to pivot about the center of the arcuate shape of said channel section and fully slide within said channel section with only the shank segment remaining outside said channel section, said mouth portion comprising spaced apart shoulder members, the shoulder members being spaced apart a distance slightly less than the thickness of said shank segment, said shank segment being received past said shoulder members with a snap fit when said hook segment is fully inserted in said channel section, wherein said hook member is of a length such that its distal end terminates short of said closed end of said channel section in a direction substantially perpendicular to the direction of the jewelry chain connected at said hook and keeper members, whereby the hook member and the keeper member are held together in an arcuate configuration of substantially less circumference than a circle by complete mating of said hook segment with said channel section for dynamic tension at the distal end of the hook member, and by said snap fit.

2. A clasp for jewelry chains as set forth in claim 1, wherein said keeper member is attached to one end of said chain and said arcuately shaped channel section forms one part of an artistic shape.

* * * * *